United States Patent [19]

Sasaki et al.

[11] Patent Number: 4,771,253

[45] Date of Patent: Sep. 13, 1988

[54] OPERATION INDICATING DEVICE FOR ELECTROMAGNETIC RELAY

[75] Inventors: Naruhito Sasaki, Suita; Toshiyuki Kasama, Takaoka; Shigeru Tsujimura; Toshio Watanabe, both of Toyoma, all of Japan

[73] Assignee: Idec Izumi Corporation, Osaka, Japan

[21] Appl. No.: 51,428

[22] Filed: May 19, 1987

[30] Foreign Application Priority Data

May 28, 1986 [JP] Japan ..... 61-81212[U]

[51] Int. Cl.[4] ..... H01K 7/14

[52] U.S. Cl. ..... 335/17; 335/128; 335/276

[58] Field of Search ..... 335/17, 128, 276

[56] References Cited

U.S. PATENT DOCUMENTS 3,083,359 3/1963 Smith ..... 335/17 X

FOREIGN PATENT DOCUMENTS 240739 10/1964 Austria ..... 335/17
910333 6/1946 France ..... 335/17
781291 8/1957 United Kingdom ..... 335/17
1137265 12/1968 United Kingdom ..... 335/17

*Primary Examiner*—George Harris
*Attorney, Agent, or Firm*—Pollock, Vande Sande & Priddy

[57] ABSTRACT

An operation indicating device for electromagnetic relay which comprises a working member interlockable with an armature of an electromagnetic relay and extending into a space above a yoke, and an indicating member coupled to the working member and having an axis rotatably supported in the space above the yoke, the indicating member having a recognizable indicating portion and being rotatable by the working member interlocking with the armature during the operation of the armature, the indicating portion of indicating member thus rotated arriving at a position corresponding to an indication window formed in a case cover.

When the armature is activated, the working member, interlockable with armature, is activated and the indicating member coupled to the working member is rotated around a supporting shaft serving as the fulcrum. The indicating portion of the indicating member moves to a position located immediately below an indication window formed in the case cover and the operation of the electromagnetic relay can be visibly confirmed.

16 Claims, 2 Drawing Sheets

OPERATION INDICATING DEVICE FOR ELECTROMAGNETIC RELAY

BACKGROUND OF THE INVENTION

1. Field of the Invention

The present invention relates to an operation indicating device for an electromagnetic relay and in particular to an operation indicating device for an electromagnetic relay wherein the display configuration is simplified to substantially widen the space within the case cover and make it effectively usable.

2. Description of the Related Art

Some conventional electromagnetic relays have operation indicating devices for indicating the open/close states of the relays. One example of their configurations is shown in FIGS. 8A and 8B. FIG. 8A is the side view of a longitudinal section of a conventional electromagnetic relay and FIG. 8B is the front view of a longitudinal section of the electromagnetic relay. In this prior art example, a slender operation indicating member 9 made of an elastic material is erectly installed on a base 2 of the electromagnetic relay 1. A piece 9*a* formed by cutting and raising one portion of a middle part in the operation indicating member 9 is linked to an insulation plate 5*a* attached to an armature 5. When the contact of the electromagnetic relay 1 is closed, i.e., when the armature 5 is attracted to a core 3*a* of an electromagnetic coil 3, the operation indicating member 9 is drawn to the electromagnetic coil 3 so that an indicating portion 9*b* formed by bending the upper end of the operation indicating member 9 in a reversed L form may be confronted by an indication window 8*a* formed in a case cover 8. As a result, the operative state of the electromagnetic relay 1 is indicated through the window 8*a*. Reference numerals 4, 6 and 7 denote a yoke, a movable contact plate and a return spring, respectively.

In the above described operation indicating device of the electromagnetic relay 1, the operation indicating member 9 is so disposed as to be opposed to the armature 5. The space near the contact is thus reduced. As a result, it is difficult to obtain a sufficient insulation distance, and insulation is deteriorated by the deposition of carbon caused by arc when the contact is opened or closed. The problem of limitation in the number of contact poles is also incurred.

SUMMARY OF THE INVENTION

An object of the present invention is to provide an operation indicating device for an electromagnetic relay in which the space near the contact is broadened to use the space effectively and a sufficient insulation distance is assured to prevent the insulation deterioration by simplifying the configuration thereof.

An operation indicating device for electromagnetic relay according to the present invention comprises a working member supported so as to be able to interlock with an armature of an electromagnetic relay, the working member being so formed as to extend into a space above the yoke, and an indicating member coupled to the working member, the indicating member having an axis rotatably supported in the space above the yoke, the indicating member having a recognizable indicating portion represented by coloring or the like, the indicating member being rotated by the working member interlocking with the armature during the operation of the armature, the indicating portion of the indicating member thus rotated arriving at a corresponding position immediately below an indication window formed in a case cover.

When the armature is activated in the above described structure, the working member supported so as to be able to interlock with the armature is activated. Accordingly, the indicating member coupled to the working member is rotated around a supporting shaft serving as the fulcrum. The indicating portion disposed on the indicating member thus moves to a position located immediately below an indication window formed in the case cover. Accordingly, it becomes possible to confirm the operation of the electromagnetic relay by observing the indicating portion of the indicating member through the indication window.

DESCRIPTION OF THE PREFERRED EMBODIMENTS

Embodiments of the present invention will now be described by referring to appended drawings.

Figure 8A:
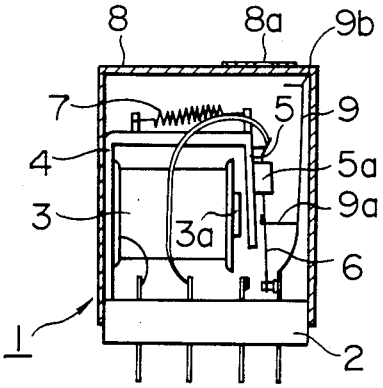
FIG. 8A PRIOR ART
FIG. 8A is a side longitudinal section of a conventional operation indicating device for the electromagnetic relay.
Figure 8B:
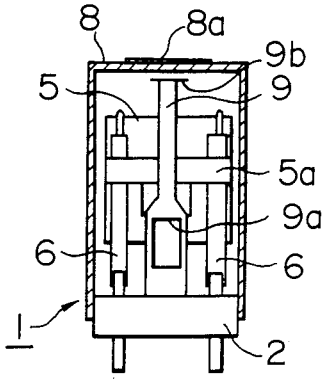
FIG. 8B PRIOR ART
FIG. 8B is a front longitudinal section of the conventional prior art operation indicating device for the electromagnetic relay.

In the following figures, the same components as those shown in FIGS. 8A and 8B are denoted by corresponding identical reference characters, respectively.

Figure 1:
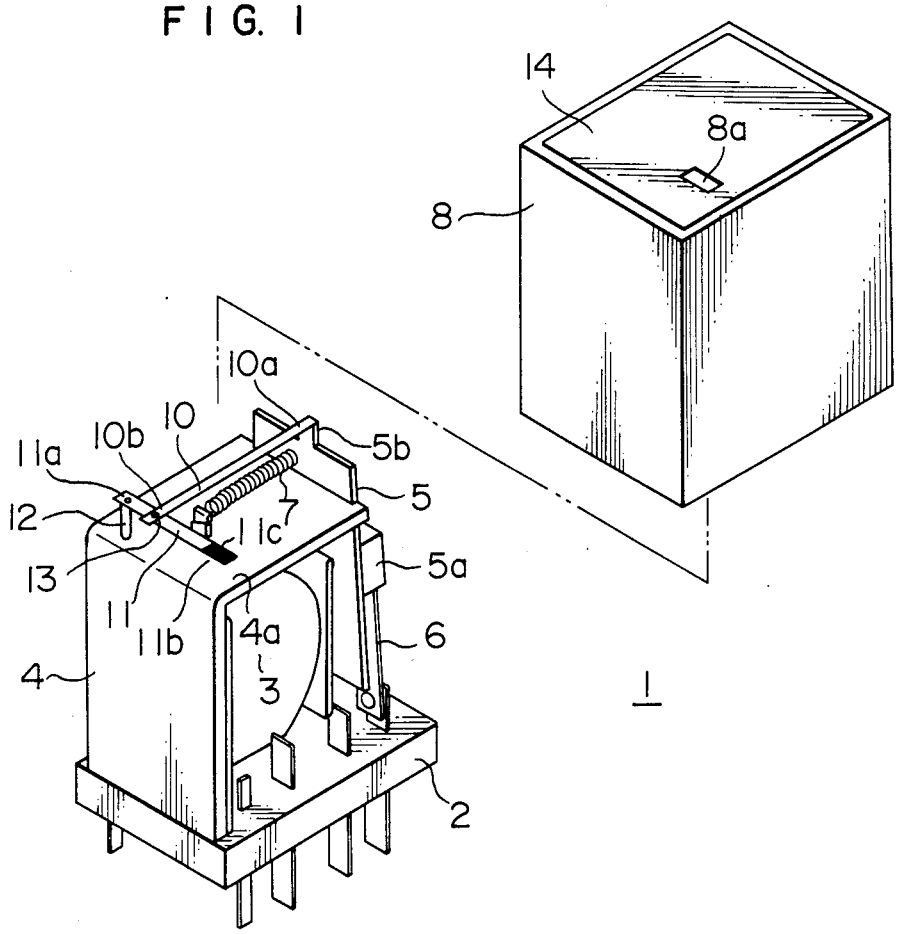
FIG. 1 is a schematic perspective view illustrating the internal structure of an electromagnetic relay and the external case of the relay according to the present invention as well as the relation between them.

In FIG. 1, a base end portion 10*a* of a working member 10 made of a resin material having shape of a slender plate is affixed to a projection 5*b* for retaining a return spring 7 formed on the upper end of an armature 5 of an electromagnetic relay 1 by a binding agent or the like. A free end portion 10*b* which is the other end of the working member 10 projects into the space above a yoke 4 substantially in parallel to the upper face 4*a* of the yoke. The free end portion 10*b* of the working member 10 is rotatably coupled by a shaft pin 13 to the middle part of an indicating member 11 made of a resin material and taking the shape of a slender plate. A base end portion 11*a* of the indicating member 11 has an axis rotatably supported by a supporting shaft 12 which is erected on a position of the upper face 4a of the yoke. The other end of the indicating member 11, a free end portion 11b is colored red, for example, to form an indicating portion 11*c*. Alternatively, the indicating member 11 may be entirely colored. When the armature 5 is attracted to the core (not illustrated) of an electromagnetic coil 3, therefore, the working member 10 moves in a direction opposite to the operation direction of a movable contact plate 6 to draw the indicating member 11. Accordingly, the indicating member 11 is rotated around the supporting shaft 12 to move the indicating portion 11*c* toward the armature 5. An indication window 8*a* is formed at a position of the case cover 8 corresponding to the position whereto the indicating portion 11*c* moves. Thus the indicating portion 11*c* can be observed through the indication window 8*a*. It is possible to confirm the operation indication of the electromagnetic relay 1. The indication window 8*a* can be formed by sticking an opaque seal 14 having a rectangular opening onto the upper face of a transparent case cover 8. For another embodiment the indication window 8*a* may also be formed by providing the case cover 8 itself with an opaque part and a transparent part.

Figure 2:
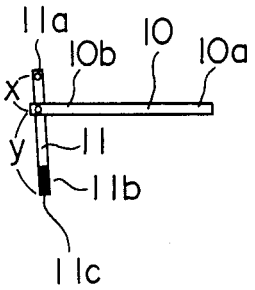
FIG. 2 is a schematic plan view illustrating the configuration of an operation indicating device according to the present invention.

In the indicating device thus constructed, the operation stroke of the indicating portion 11*c* can be adjusted by changing a position on the indicating portion 11 whereto the working member 10 is coupled (or by changing the ratio x:y) as shown in FIG. 2. Therefore, the operation indicating device can be used in conformity with the types of various electromagnetic relays. Further, it is also possible to couple the working member 10 to the indicating member 11 so that a fulcrum which rotatably supports the indicating member 11 may be located at the middle position of the indicating member 11.

Figure 3:
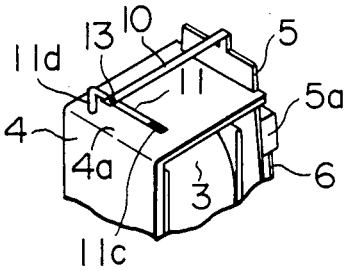
FIGS. 3 to 7 are schematic, partial perspective views illustrating alternate embodiments of the operation indicating device of the electromagnetic relay.
Figure 4:
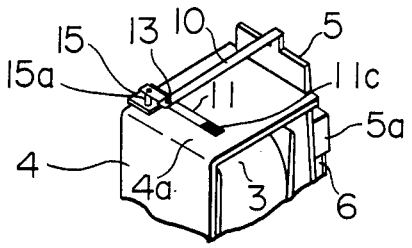
Figure 5:
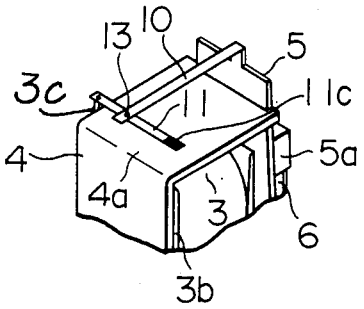
Figure 6:
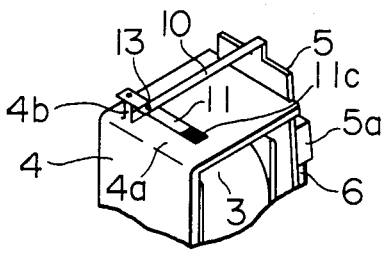
Figure 7:
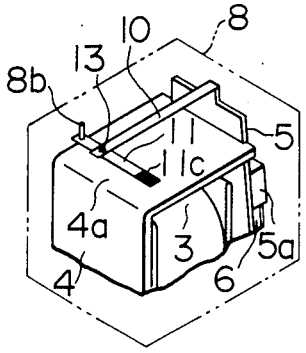

FIGS. 3 to 7 show other embodiments of the operation indicating device. In FIG. 3, the indicating member 11 is made as a single body with the supporting shaft 11*d* to take the shape of letter L. And the supporting shaft 11*d* is rotatably inserted into a shaft hole opened on an upper face 4*a* of the yoke. In FIG. 4, a supporting shaft 15*a* is erected on a fixed plate 15 having a section resembling the shape of ⊐ caught in an edge of the upper face 4*a* of the yoke. The indicating member 11 has an axis rotatably supported on the supporting shaft 15*a*. In FIG. 5, molded resin forming the flange of a bobbin 3*b* of an electromagnetic coil 3 is so extended as to be used as a supporting shaft 3*c*. In FIG. 6, a portion of the upper face 4*a* of the yoke is cut and folded back upwardly to form a supporting shaft 4*b* for supporting the indicating member 11 at the rotation axis thereof. In FIG. 7, a supporting shaft 8*b* is suspended inside the upper face of the case cover 8, and the indicating member 11 is rotatably attached to the supporting shaft 8*b*.

In each of the above described embodiments, it is also possible to dispose the indicating portion 11*c* located on an end of the indicating member 11 nearer the indication window 8*a* of the case cover 8 by forming a stair-like bent portion in the indicating member 11.

On the other hand, various methods for attaching the working member 10 can be considered. For example, resin of the insulation plate 5*a* attached to the armature 5 may be extended to fix the working member 10 thereto. Or the upper end of the movable contact plate 6 fixed to the insulation plate 5*a* may be extended upward to fix the working member 10 thereto. Alternatively, an insulation sheet which is not illustrated in the figures and which is disposed between the armature 5 and the insulation plate 5*a* may be extended to fix the working member 10 thereto. In this way, further various structures for fixing the working member 10 and the indicating member 11 can be considered by combining the above described structures.

In accordance with the present invention described above, the mechanism for indicating the operation is entirely disposed above the electromagnetic coil portion. Therefore, it is a matter of course that the position adjustment can be simply carried out. In addition, the surroundings of the contact portion can be made similar to a conventional electromagnetic relay which is not provided with the operation indicating device. Therefore, the reduction in insulation distance caused by the presence of the operation indicating member is obviated. The insulation deterioration is also prevented. In addition, the number of contact poles need not be limited. Effects in the operation can also be attained. That is to say, the attraction operation of the armature and the change in return voltage are hardly affected due to the structure using the link mechanism. Further, the number of components for the structure is not large. Accordingly, the simple mechanism results in improved reliability, reduced fabrication steps and a lower cost.

We claim:

1. In a hinged type electromagnetic relay, a compact operation indicating device for electromagnetic relay comprising:

a working member supported in a relay case and interlockable with a movable contact portion, said working member occupying a relatively small space within said relay case distant from said contact portion; and an indicating member coupled to said working member and rotatably supported by a shaft, said indicating member having a recognizable indicating portion, said indicating member being rotatable by said working member interlocking with said movable contact portion during the operation of said movable contact portion, the indicating portion of said indicating member thus rotated arriving at a position corresponding to an indication window formed in a case cover of the electromagnetic relay, wherein said working member and said indicating member are substantially flat plate members.

2. An operation indicating device for electromagnetic relay according to claim 1, wherein said movable contact portion comprises an armature.

3. An operation indicating device for electromagnetic relay according to claim 1, wherein said movable contact portion comprises an extension of resin of an insulation plate.

4. An operation indicating device for electromagnetic relay according to claim 1, wherein said movable contact portion comprises an extension of the upper end of a movable contact plate.

5. An operation indicating device for electromagnetic relay according to claim 1, wherern said space comprises a space above a yoke.

6. An operation indicating device for electromagnetic relay according to claim 1, wherein the coupling point between said working member and said indicating member is adjustable.

7. An operation indicating device for electromagnetic relay according to claim 1, wherein said indicating member is formed in the shape of letter L, and a part of said indicating member is used as a supporting shaft and rotatably inserted into a shaft hole formed in the upper face of the yoke.

8. An operation indicating device for electromagnetic relay according to claim 1, wherein said indicating member has an axis rotatably supported by a supporting shaft erected on a fixed plate having a section resembling the shape of , and said fixed plate is caught in an edge portion of the upper face of said yoke.

9. An operation indicating device for electromagnetic relay according to claim 1, wherein said indicating member has a rotation axis supported by an extension of molded resin forming a flange of a bobbin of the electromagnetic coil.

10. An operation indicating device for electromagnetic relay according to claim 1, wherein said indicating member has an axis supported by a supporting shaft which is erected by curring and folding back upwardly a portion of the upper face of said yoke.

11. An operation indicating device for electromagnetic relay according to claim 1, wherein said indicating member is rotatably attached to a supporting shaft suspended inside the upper face of said case cover.

12. An operation indicating device for electromagnetic relay according to claim 1, wherein said indicating member is entirely colored to form said indicating portion.

13. In a hinged type electromagnetic relay, an operation indicating device for electromagnetic relay comprising:

a working member interlockable with an armature, said working member being positioned into a relay case within a small space above the yoke; and an indicating member coupled to said working member, said indicating member having an axis rotatably supported in a space above said yoke, said working member and said indicating member being substantially rectangular elongated plates, said indicating member having a recognizable indicating portion represented by coloring, said indicating member being rotated by said working member interlocking with said armature during the operation of said armature, the indicating portion of said indicating member thus rotated arriving at a corresponding position located immediately below an indication window formed in a case cover of the electromagnetic relay.

14. An operation indicating device for electromagnetic relay according to claim 1, wherein said indicating member is partially colored to form said indicating portion.

15. In a hinged type electromagnetic relay, a compact operation indicating device positioned in a case of the relay in a space separated from a movable contact position of the relay said indicating device comprising:

a working member having one end interlockable with the contact position;

and an indicating member having a first end rotatable about a supporting shaft mounted above the yoke; and a second end including a recognizable indicating position, said indicating member being connected to and rotatable by said working member while interlocking with said contact position during the operation of said movable contact position, said indicating portion of said indicating member thus rotated arriving at a position corresponding to an indication window formed in a case cover at the electromagnetic relay.

16. An operation indicating device according to claim 15 wherein said working and said indicating member each comprise a substantially flat, rectangular plate.

* * * * *